343-700 MS AU 256 EX
1/3/78 OR 4,067,016

United States Patent [19]

Kaloi

[11] 4,067,016

[45] Jan. 3, 1978

[54] DUAL NOTCHED/DIAGONALLY FED ELECTRIC MICROSTRIP DIPOLE ANTENNAS

[75] Inventor: Cyril M. Kaloi, Thousand Oaks, Calif.

[73] Assignee: The United States of America as represented by the Secretary of the Navy, Washington, D.C.

[21] Appl. No.: 740,692

[22] Filed: Nov. 10, 1976

[51] Int. Cl.[2] ..... H01Q 1/38; H01Q 9/28

[52] U.S. Cl. ..... 343/700 MS; 343/795; 343/830

[58] Field of Search ..... 343/700 MS, 830, 846, 343/853, 908, 769, 795

[56] References Cited

U.S. PATENT DOCUMENTS

| | | | |
|---|---|---|---|
| 3,478,362 | 11/1969 | Ricardi et al. | 343/769 |
| 3,947,850 | 3/1976 | Kaloi | 343/846 |
| 3,984,834 | 10/1976 | Kaloi | 343/700 MS |
| 4,012,741 | 3/1976 | Johnson | 343/853 |

*Primary Examiner*—Alfred E. Smith
*Assistant Examiner*—Harry Barlow
*Attorney, Agent, or Firm*—Richard S. Sciascia; Joseph M. St.Amand

[57] ABSTRACT

Circularly polarized microstrip antennas consisting of thin electrically conducting, square-shaped radiating elements formed on one surface of a dielectric substrate and having a ground plane on the opposite surface of the substrate. Two feed points are used to provide a circular polarized radiation pattern. The feed points are located along the centerlines of the antenna length and width or along the diagonal lines of the element and the input impedances can be varied by moving the feed points along both centerlines or both diagonal lines from the centerpoint of the element. The antennas can be notched in from the edges of the radiating element along the centerlines of the element width and length, or along opposite diagonal lines of the element, to the optimum input impedance match feed point.

8 Claims, 10 Drawing Figures

DUAL NOTCHED/DIAGONALLY FED ELECTRIC MICROSTRIP DIPOLE ANTENNAS

This invention is related to U.S. Pat. No. 3,972,049 issued July 27, 1976 for ASYMMETRICALLY FED ELECTRIC MICROSTRIP DIPOLE ANTENNA; U.S. Pat. No. 3,984,834 issued Oct. 5, 1976 for DIAGONALLY FED ELECTRIC MICROSTRIP DIPOLE ANTENNA; U.S. Pat. No. 3,947,850 issued Mar. 30, 1976, for NOTCH FED ELECTRIC MICROSTRIP DIPOLE ANTENNA.

This invention is also related to copending U.S. patent applications: Ser. No. 740,696 for NOTCHED/-DIAGONALLY FED ELECTRIC DIPOLE ANTENNA; Ser. No. 740,694 for ELECTRIC MONOMICROSTRIP DIPOLE ANTENNAS; Ser. No. 740,690 for TWIN ELECTRIC MICROSTRIP DIPOLE ANTENNAS; and Ser. No. 740,695 for ASYMMETRICALLY FED MAGNETIC MICROSTRIP ANTENNA; all filed together herewith on Nov. 10, 1976, by Cyril M. Kaloi, and commonly assigned.

SUMMARY OF THE INVENTION

The antennas as hereinafter described can be used in missiles, aircraft and other type applications where a low physical profile is desired. The present antennas can provide radiation patterns from circular to linear and can be arrayed for telemetry, radar, beacons, tracking, etc. By arraying several of the present antenna elements, more flexibility in forming radiation patterns is permitted. In addition, these antennas can be designed for any desired frequency within a limited bandwidth, preferably below 25 GHz, since other types of antennas can give better antenna properties above 25 GHz. The antennas of this invention are particularly suited to receive and radiate electromagnetic energy in the 1435–1535 MHz and the 2200–2290 MHz bands. The design technique used provides antennas with ruggedness, simplicity, low cost, a low physical profile, and conformal arraying capability about the body of a missile or vehicle where used including irregular surfaces, while giving excellent radiation coverage. These antennas can be arrayed over an exterior surface without protruding, and be thin enough not to affect the airfoil or body design of the vehicle. The thickness of any of the present antennas can be held to an extreme minimum depending upon the bandwidth requirement; antennas as thin as 0.005 inch for frequencies above 1,000 MHz have been successfully produced. Due to their conformability, these antennas can be applied readily as a wrap around band to a missile body without the need for drilling or injuring the body and without interfering with the aerodynamic design of the missile. The antennas can be easily matched to most practical impedances by varying the location of the feed point. The thickness of the dielectric substrate in these microstrip antennas should be much less than ¼ the wavelength.

An advantage of the antennas of this invention over other similar appearing types of microstrip antennas is that the present antennas can be fed easily at locations away from the edges of the element with either coaxial-to-microstrip adapters or with etched microstrip transmission lines depending upon the antenna element design.

DESCRIPTION OF PREFERRED EMBODIMENTS

Figure 1A:
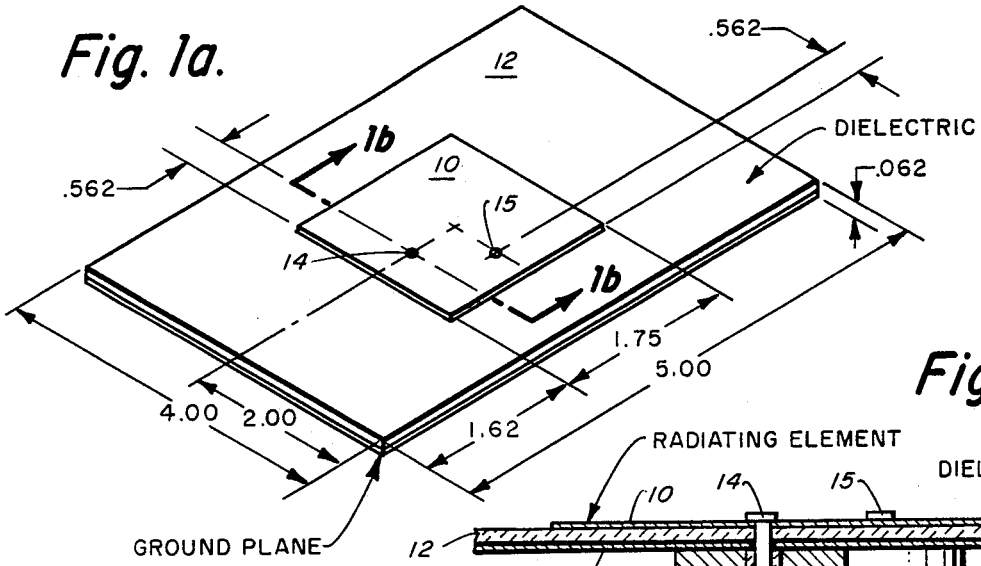
FIG. 1*a* is an isometric planar view of a typical square dual asymmetrically fed electric microstrip dipole antenna.
Figure 1B:
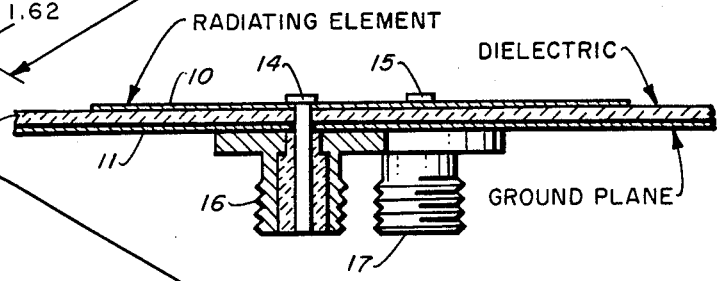
FIG. 1*b* is a cross-sectional view taken along the section line 1*b*—1*b* of FIG. 1*a* and also shows dual coaxial-to-microstrip adapters.

A dual asymmetrically fed microstrip antenna is shown in FIGS. 1*a* and 1*b*. The element 10 is separated from the ground plane 11 by dielectric substrate 12.

In the circularly polarized dual asymmetrically fed electric microstrip antenna the element width equals the element length and is fed simultaneously along both the centerline of the width and the centerline along the length, each of the feed points 14 and 15 being at the same distance from the center of the antenna element. The length of the radiating element determines the resonant frequency, and in this antenna the element length equals the width. The element is fed from the ground plane side with two coaxial-to-microstrip adapters 16 and 17, as shown in FIG. 1*b*. Two coaxial transmission lines having a phase difference of 90° interconnected to a power splitter at one end of coaxial transmission lines are connected at the other ends to the element by adapters 16 and 17 to provide circular polarization. If variable polarization is desired, a variable phase shifter can be included in one of the transmission lines.

The design equations used in the Asymmetrically Fed Electric Microstrip Antenna disclosed in aforementioned U.S. Pat. No. 3,972,049 applies to the dual asymmetrically fed antenna disclosed herein, except that only half the power is coupled to each mode of oscillation, and in addition, the radiation patterns will be different if there is a phase difference between the modes of oscillation, i.e., other than linear polarization. This will give elliptical or circular polarization and therefore complex radiation patterns will be observed.

Figure 2:
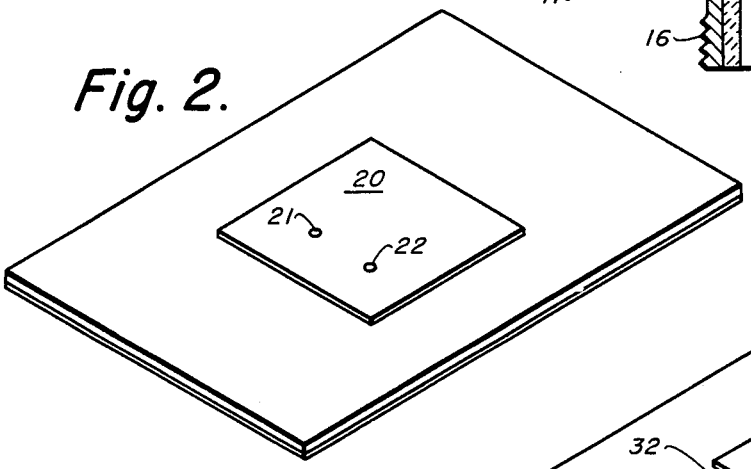
FIG. 2 is an isometric planar view of a typical square dual diagonally fed electric microstrip dipole antenna.

With the dual diagonally fed microstrip antenna shown in FIG. 2 the antenna element 20 is fed simultaneously at feed points 21 and 22 along the two opposite diagonal lines. The feed points are located equidistantly from the antenna center-point on the opposite diagonal lines. The antenna is fed with coaxial-to-microstrip adapters and transmission lines as in the circularly polarized dual asymmetrically fed microstrip antenna discussed above. The element 20 is separated from the ground plane by the dielectric substrate.

The design equations used for the Diagonally Fed Electric Microstrip antenna disclosed in aforementioned U.S. Pat. No. 3,984,834 applies in the most part to the dual diagonally fed antenna disclosed herein, except that only one half the power is coupled to each mode of oscillation for energizing the radiation element, and in addition, the radiation patterns will be different if there is a phase difference between the modes of oscillation (i.e., other than linear polarization), thus giving elliptical or circular polarization. Complex radiation patterns will be observed whenever there is a phase difference between the modes of oscillation.

Figure 3:
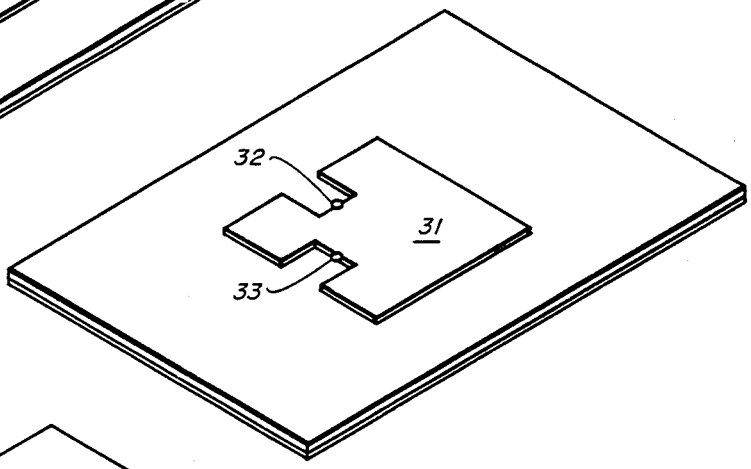
FIG. 3 is an isometric planar view of a typical square dual notch fed electric microstrip dipole antenna.
Figure 4:
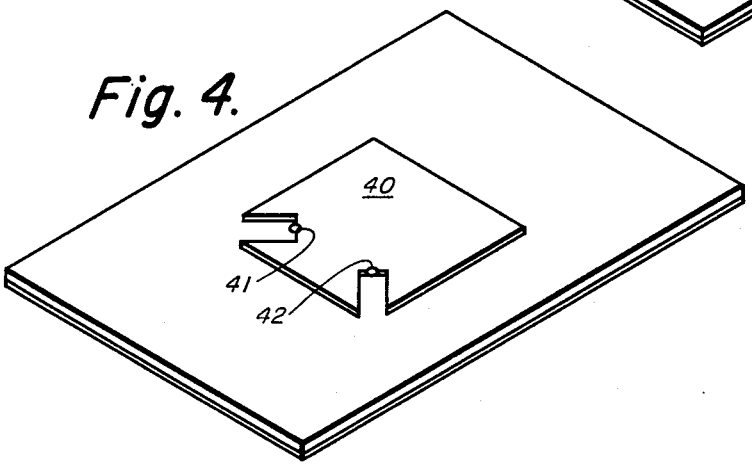
FIG. 4 is an isometric planar view of a typical square dual notched/diagonally fed electric microstrip dipole antenna.

Double notched antennas are shown in both FIGS. 3 and 4 for providing circularly polarized radiation patterns, as well as various polarizations from circular to linear including all the elliptical polarization phases therebetween. As shown in the drawings, the double notched antennas can be notched and fed at the optimum feed points along the center-lines of the length and width as in the dual asymmetrically fed antenna, or can be notched and fed at the optimum feed points along the two diagonals of the element as in the dual diagonally fed antenna. The size of the notches, i.e., the length and width dimensions, will have some slight effect on the resonant frequency of the radiating element in the dual notched antennas.

In the double notch antenna shown in FIG. 3, a square element 31 is notched along the centerline of both the length and width of element with the feed points 32 and 33 each located at the same distance from the element center point. Microstrip transmission lines etched along with the element can be used as the interconnecting feed lines. Matching transmission lines are not needed since the element can be notched to the optimum feed points to match the input impedance desired. Therefore, simple 100 ohm transmission lines can be used to interconnect the element feed points at each of the notches and then fed to a simple microstrip power divider which will combine to provide an input impedance of 50 ohms, for example. The input impedance at each notch is determined in the same manner as disclosed in U.S. Pat. No. 3,947,850 for Notch Fed Electric Microstrip Antenna. Phase shifters can be used in one or both lines for providing any desired phase shifting.

The dual notched/diagonally fed microstrip antenna shown in FIG. 4 permits feeding the antenna element 40 with microstrip transmission lines at the optimum feed points 41 and 42 along the diagonals of the element. This also allows arraying of multiple antennas on a single substrate using microstrip feedlines etched along with the elements. Notching the antenna element at two locations equidistant from the center point of element 40 and feeding along the diagonals away from the edges of the elements with microstrip transmission lines at 90° phase difference from each other can provide circular polarization. Dual transmission lines allow variable phase shifting by inserting a variable phase shifter in one transmission line, whereas in the single Notched/Diagonally Fed Electric Microstrip Antenna disclosed in aforementioned copending U.S. patent application, Ser. No. 740,696 the polarization (i.e., right or left-hand) is fixed depending on which side of the element is shorter with respect to the other. In addition, in the single fed notched/diagonal antenna one side must be shorter than the other to get circular polarization, whereas the length and width can be exactly the same with the dual fed notched/diagonal antenna to obtain circular polarization.

The input impedance of each of the notches on the diagonals of the element can be determined in the same manner as disclosed in the aforementioned U.S. patent application, Ser. No. 740,696 for a single Notched/Diagonally Fed Electric Microstrip Antenna.

Figure 5:
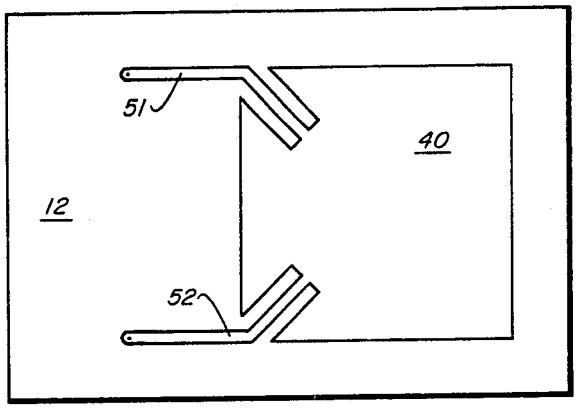
FIG. 5 shows a typical dual notched/diagonally fed electric microstrip antenna with microstrip transmission lines.

The dual notched fed and dual notched/diagonally fed electric microstrip antennas can be etched together with microstrip transmission lines 51 and 52, such as shown in FIG. 5, for example, by techniques similar to that used for printed circuits.

Figure 6:
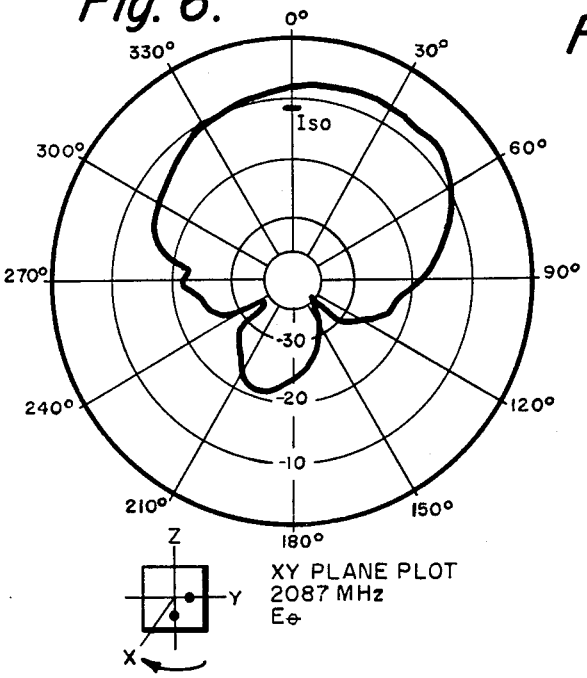
FIG. 6 is an antenna radiation pattern (XY plane plot) showing vertical polarization for the dual asymmetrically fed electric microstrip antenna of FIGS. 1*a* and 1*b*.
Figure 7:
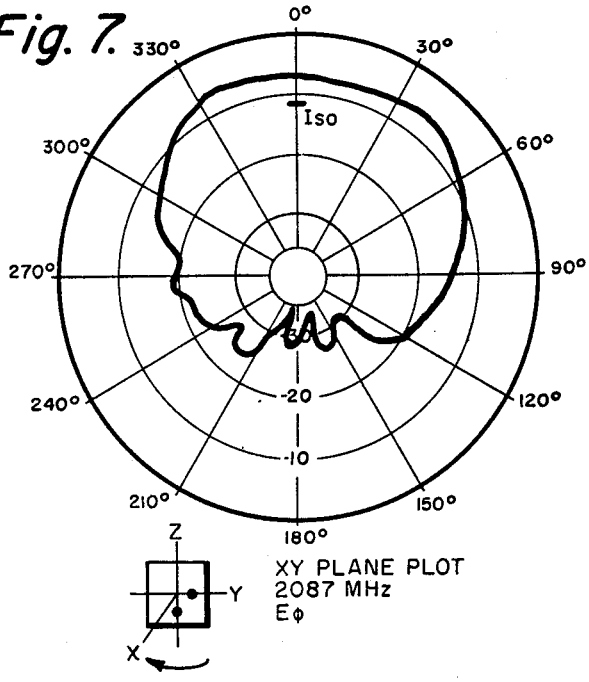
FIG. 7 is an antenna radiation pattern (XY plane plot) showing horizontal polarization for the typical antenna of FIGS. 1*a* and 1*b*.

FIGS. 6 and 7 show XY plane plots for vertical and horizontal polarization, respectively, for the dual asymmetical fed antenna having dimensions as shown in FIGS. 1*a* and 1*b*. As can be observed, the difference in maximum gain is approximately ½ db which indicates good circular polarization of the antenna.

Figure 8:
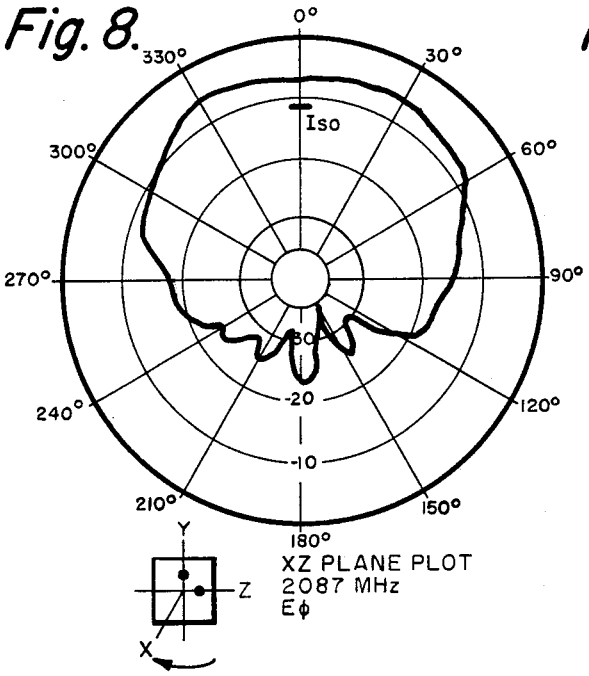
FIG. 8 is an antenna radiation pattern (XZ plane plot) showing horizontal polarization for the dual asymmetrically fed antenna of FIGS. 1*a* and 1*b*.
Figure 9:
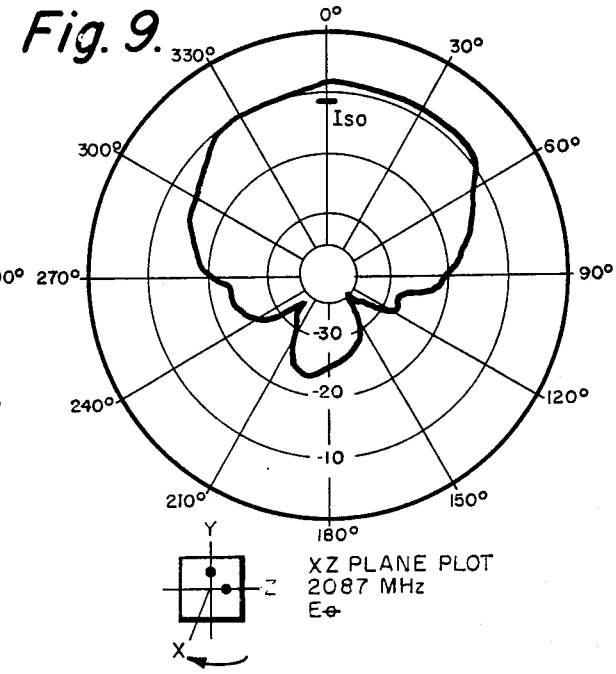
FIG. 9 is an antenna radiation pattern (XZ plane plot) showing vertical polarization for the typical antenna of FIGS. 1*a* and 1*b*.

FIGS. 8 and 9 show similar plots for the XZ plane. Again, the plots show good polarization. In addition, in comparing the plots in FIGS. 6 and 7 with those in FIGS. 8 and 9 the shape of the radiation pattern is very similar, also indicating good circular polarization.

The XY and XZ plane plots for the dual diagonally fed antenna are very similar to those shown for the dual asymmetrically fed antenna and therefore are not shown here. The radiation patterns for the dual notch fed antennas are also similar to those shown for the dual asymmetrically fed antenna.

Obviously many modifications and variations of the present invention are possible in the light of the above teachings. It is therefore to be understood that within the scope of the appended claims the invention may be practiced otherwise than as specifically described.

What is claimed is:

1. A dual notched/diagonally fed electric microstrip dipole antenna having low physical profile and conformal arraying capability, comprising:

a. a thin ground plane conductor;

b. a thin square radiating element for producing a radiation pattern being spaced from said ground plane;

c. said square radiating element being electrically separated from said ground plane by a dielectric substrate;

d. said square radiating element having a first feed point located along one diagonal line of the square radiating element and a second feed point located along the other diagonal line of the square radiating element, said diagonal lines being normal to one another; said first and second feed points being equidistant from the center point of said square radiating element;

e. said square radiating element having a first notch extending into said square radiating element along said one diagonal line of the square radiating element from the outer edge thereof to said first feed point and having a second notch extending into said square radiating element along said other diagonal line of the square radiating element from the outer edge thereof to said second feed point;

f. the resonant frequency of the antenna being determined primarily by the length of said square radiating element; the width of said first and second notches having a slight effect on the resonant frequency, as the width of the notches is increased the resonant frequency being increased slightly and vice versa;

g. the antenna input impedance being variable to match most practical impedances as said feed points are equidistantly moved along said diagonal lines between the square radiating element center point and edge of the square radiating element;

h. the antenna bandwidth being variable with the width of the square radiating element and the spacing between said square radiating element and said ground plane, said spacing between the square radiating element and the ground plane having somewhat greater effect on the bandwidth than the square radiating element width;

i. said square radiating element being operable to oscillate in two modes of current oscillation, each of said two modes being orthogonal to the other.

2. An antenna as in claim 1 wherein the length of said square radiating element is approximately ½ wavelength.

3. An antenna as in claim 1 wherein said square radiating element is fed along said diagonal line at the respective feed points at the inner end of said first and second notches with a pair of microstrip transmission lines.

4. An antenna as in claim 1 wherein each of the two modes of oscillation have the same properties and one half of the available power is coupled to one mode of oscillation and one half of the available power is coupled to the other mode of oscillation.

5. An antenna as in claim 1 wherein first and second transmission lines are connected at one end thereof to said first and second feed points, respectively.

6. An antenna as in claim 1 wherein said first and second transmission lines have a 90° phase difference between them to provide circular polarization of the antenna.

7. An antenna as in claim 1 wherein said transmission lines are interconnected at the other ends thereof to power splitter.

8. An antenna as in claim 1 wherein a variable phase shifter is included in one of the transmission lines.

* * * * *